US012270004B2

(12) United States Patent
Fenton et al.

(10) Patent No.: US 12,270,004 B2
(45) Date of Patent: Apr. 8, 2025

(54) LUBRICANT COMPOSITION

(71) Applicant: BASF SE, Ludwigshafen am Rhein (DE)

(72) Inventors: Ryan James Fenton, Tarrytown, NY (US); Roger Kuhlman, Floram Park, NJ (US)

(73) Assignee: BASF SE, Ludwigshafen Am Rhein (DE)

( * ) Notice: Subject to any disclaimer, the term of this patent is extended or adjusted under 35 U.S.C. 154(b) by 0 days.

(21) Appl. No.: 18/238,104

(22) Filed: Aug. 25, 2023

(65) Prior Publication Data

US 2023/0399577 A1 Dec. 14, 2023

Related U.S. Application Data

(62) Division of application No. 17/272,476, filed as application No. PCT/US2019/047677 on Aug. 22, 2019, now abandoned.

(60) Provisional application No. 62/724,674, filed on Aug. 30, 2018.

(51) Int. Cl.

| | |
|---|---|
| ***C10M 141/06*** | (2006.01) |
| ***C10M 133/06*** | (2006.01) |
| ***C10M 133/40*** | (2006.01) |
| ***C10M 135/10*** | (2006.01) |
| ***C10M 141/08*** | (2006.01) |
| ***C10M 169/04*** | (2006.01) |
| *C10N 30/00* | (2006.01) |
| *C10N 30/04* | (2006.01) |
| *C10N 30/12* | (2006.01) |
| *C10N 40/25* | (2006.01) |

(52) U.S. Cl.

CPC ..... *C10M 141/08* (2013.01); *C10M 133/06* (2013.01); *C10M 133/40* (2013.01); *C10M 135/10* (2013.01); *C10M 169/04* (2013.01); *C10M 2203/003* (2013.01); *C10M 2215/26* (2013.01); *C10M 2215/30* (2013.01); *C10M 2219/044* (2013.01); *C10N 2030/04* (2013.01); *C10N 2030/12* (2013.01); *C10N 2030/52* (2020.05); *C10N 2040/252* (2020.05)

(58) Field of Classification Search

CPC ..... C10M 141/08; C10M 133/06; C10M 133/40; C10M 135/10; C10M 169/04; C10M 2203/003; C10M 2215/26; C10M 2215/30; C10M 2219/044; C10M 141/06; C10N 2030/04; C10N 2030/12; C10N 2030/52; C10N 2040/252

USPC ..... 508/262

See application file for complete search history.

(56) References Cited

U.S. PATENT DOCUMENTS

| | | | | |
|---|---|---|---|---|
| 5,073,278 | A * | 12/1991 | Schumacher | C10M 133/12 508/262 |
| 2010/0160195 | A1 | 6/2010 | Cheng et al. | |
| 2012/0202728 | A1* | 8/2012 | Garcia Ojeda | C10M 163/00 508/545 |
| 2015/0203783 | A1* | 7/2015 | Hoey | C10M 149/10 508/262 |
| 2015/0291906 | A1 | 10/2015 | Desantis et al. | |
| 2015/0344808 | A1* | 12/2015 | Lagona | C10M 161/00 508/306 |

FOREIGN PATENT DOCUMENTS

| | | |
|---|---|---|
| WO | 2011/042552 A1 | 4/2011 |
| WO | 2015/066690 A1 | 5/2015 |

OTHER PUBLICATIONS

International Preliminary Report on Patentability received for PCT Patent Application No. PCT/US2019/047677, mailed on Mar. 11, 2021, 7 pages.

International Search Report and Written Opinion received for PCT Patent Application No. PCT/US2019/047677, mailed on Nov. 28, 2019, 8 pages.

* cited by examiner

*Primary Examiner* — Taiwo Oladapo
*Assistant Examiner* — Francis C Campanell
(74) *Attorney, Agent, or Firm* — Faegre Drinker Biddle & Reath LLP

(57) ABSTRACT

A lubricant composition for a compression-ignition internal combustion engine includes an amine and a detergent selected from metal sulfonates, phenates, salicylates, carboxylates, thiophosphonates, and combinations thereof. The lubricant composition has a TBN of from about 10 to about 100 mg KOH/g when tested according to ASTM D2896. The amine contributes from about 0.1 to about 28% of the TBN of the lubricant composition. Further, a method of lubricating an internal combustion engine with the lubricant composition includes the steps of injecting a fuel and the lubricant composition into a cylinder to form a mixture, and combusting the mixture via compression-ignition.

7 Claims, No Drawings

LUBRICANT COMPOSITION

CROSS-REFERENCE TO RELATED APPLICATIONS

This application is a division of U.S. application Ser. No. 17/272,476, filed Mar. 1, 2021, which is a National stage application (under 35 U.S.C. § 371) of PCT/US2019/047677, filed Aug. 22, 2019, which claims benefit of U.S. Application No. 62/724,674, filed Aug. 30, 2018, all of which are incorporated herein by reference in their entirety.

FIELD OF THE DISCLOSURE

The subject disclosure generally relates to an amine as an ashless fuel additive and also to a lubricant composition comprising the amine.

DESCRIPTION OF THE RELATED ART

Many internal combustion engines, such as those found in marine vessels, trains, motorcycles, scooters, ATV's, and lawn equipment, combust a mixture of a fuel and a lubricant composition. Specifically, the mixture is introduced into a cylinder of the engine and combusted to move a piston and power the engine. The lubricant composition is added to the fuel to lubricate various components of the engine (e.g. the cylinder and the piston) and to optimize combustion, fuel economy, emissions, and engine life. The lubricant composition includes base oil and additives, such as antiwear additives, dispersants, and detergents.

However, during combustion, impurities in the fuel and additives, such as overbased detergents and other additives comprising metal, do not fully combust and "burn out". As a result, ash is formed. Some of the ash formed remains in the cylinder, and can cause the build up of "deposits" and even "plate out" the engine components (e.g. the cylinder and the piston) eventually damaging the engine, reducing fuel economy, and ultimately reducing engine life.

For example, ocean going marine vessels are fueled by the combustion of a mixture of crude fuel, which often includes sulfur in high concentrations, and a lubricant composition when out at sea. The lubricant compositions used in this mixture include an overbased detergent such as calcium carbonate. The overbased detergent is present to neutralize acid which is formed by the combustion of the sulfur. However, when in emission controlled (EC) areas (e.g. coastal areas with higher environmental standards), these ocean going marine vessels are alternatively fueled by the combustion of a mixture of more refined fuel, which typically includes less sulfur, and the lubricant composition in an effort to reduce pollutants produced during combustion. When the more refined, low sulfur fuel is combusted, less acid is formed. In turn, there is an excess of overbased detergent which forms ash and plates out onto cylinder walls and other engine components thereby damaging the engine, reducing fuel economy, and ultimately reducing engine life.

Those skilled in the art have tried to replace the detergents included in lubricant compositions with various amines in an effort to overcome problems associated with the excess of detergent with limited success. However, significant loadings of amine are required, which can pose regulatory and environmental concerns. Further, 1:1 replacements of detergent with amine can be cost prohibitive. To this end, there is a need for lubricant compositions that include a minimal amount of detergent and amine, which effectively neutralize acid which is formed by the combustion of fuel comprising sulfur and also accommodate variations in fuel sulfur levels.

SUMMARY OF THE DISCLOSURE

A lubricant composition for a compression-ignition internal combustion engine is disclosed. The lubricant composition includes an amine and a detergent selected from metal sulfonates, phenates, salicylates, carboxylates, thiophosphonates, and combinations thereof. The amine may be selected from the group consisting of (I), (II), (III), (IV), and (V) as defined below:

(I)

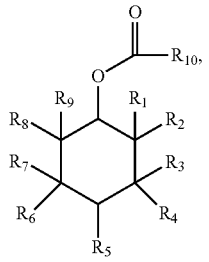

wherein each of $R_1$ to $R_9$ are independently selected from a hydrogen, a $C_{1-6}$ branched or straight alkyl or a halogen; and $R_{10}$ is selected from hydrogen, hydroxy or a $C_{1-20}$ branched or straight alkyl;

in certain embodiments, $R_1$, $R_2$, $R_5$, $R_8$, and $R_9$ are hydrogen and $R_3$, $R_4$, $R_7$ and $R_8$ are independently a $C_{1-3}$ alkyl;

in certain embodiments, $R_{10}$ is a $C_{8-15}$ alkyl;

in one embodiment, $R_1$, $R_2$, $R_5$, $R_8$, and $R_9$ are hydrogen; $R_3$, $R_4$, $R_7$ and $R_8$ are a methyl; and $R_{10}$ is a $C_{11}$ alkyl;

(II)

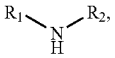

wherein $R_1$ and $R_2$ are independently selected from $C_{1-20}$ branched or straight alkyl;

in certain embodiments, $R_1$ and $R_2$ are independently selected from a $C_{6-12}$ alkyl;

in one embodiment, $R_1$ and $R_2$ are both a branched $C_8$ alkyl;

(III)

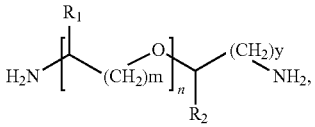

wherein each of $R_1$ and $R_2$ are independently selected from a hydrogen, a $C_{1-6}$ branched or straight alkyl or a halogen; m and y are independently an integer of 1 to 6 and n is 1 to 7;

in certain embodiments, $R_1$ and $R_2$ are independently selected from a $C_{1-3}$ alkyl;

in certain embodiments, m and y are independently an integer of 1-3;

in certain embodiments, n is an integer or a fractional number from 2 to 6.5;

in one embodiment, $R_1$ and $R_2$ are both a methyl and m and y are both 1;

in one embodiment; n is 2.5. In one embodiment, n is 6.1;

in certain embodiments, the average molecular weight (average $M_n$) of amine (III) ranges from about 100 to about 500, from about 200 to about 450, or from about 230 to about 430, about 230, or about 430.

(IV)

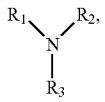

wherein $R_1$, $R_2$, and $R_3$ are independently selected from $C_{1-20}$ branched or straight alkyl;

in certain embodiments, $R_1$, $R_2$ and $R_3$ are independently selected from a $C_{6-12}$ alkyl;

in one embodiment, $R_1$, $R_2$ and $R_3$ are both a branched $C_8$ alkyl; and (V)

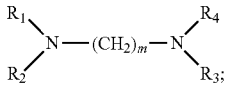

wherein $R_1$ to $R_4$ are independently selected from hydrogen and a $C_{1-6}$ alkyl and m is an integer of 1-12;

in certain embodiments, $R_1$ to $R_4$ are a $C_{1-3}$ alkyl and m is an integer of 4-8;

in one embodiment, $R_1$ to $R_4$ are a methyl and m is 6.

The lubricant composition may have a total base number ("TBN") of from about 10 to about 100 mg KOH/g when tested according to ASTM D2896. The amine may contribute from about 0.1 to about 28% of the TBN of the lubricant composition.

A method of lubricating an internal combustion engine with the lubricant composition is also disclosed. The method of lubricating an internal combustion engine includes the steps of injecting a fuel and the lubricant composition into a cylinder to form a mixture, and combusting the mixture via compression-ignition.

DETAILED DESCRIPTION OF THE DISCLOSURE

A lubricant composition for a compression-ignition internal combustion engine ("the lubricant composition") is disclosed herein. The lubricant composition may comprise an amine and a detergent.

The lubricant composition can comprise one or more of the amine, i.e., a single type of the amine or more than one type of the amine. The amine may be basic, soluble in base oils and fuels, and chemically stable, yet does not produce ash when combusted (i.e., is ashless according to ASTM D 874 and as understood in the art). Typically, the terminology "ashless" refers to the absence of significant amounts of metals such as sodium, potassium, calcium, and the like.

The amine neutralizes acid but does not form ash which, as described above, can damage engine components, reduce fuel economy, and ultimately reduce engine life. The amine effectively neutralizes acids because of its basicity. A minimal amount of the amine can be added to neutralize or "treat" fuel. That is, the amine can be used at a low "treat rate". The basicity of the amine is quantified by its TBN. TBN can be calculated theoretically and can also be determined according to ASTM D2896 and/or ASTM D4739. The amine may have a TBN of greater than about 100, alternatively greater than about 150, alternatively greater than about 200, alternatively greater than about 400, alternatively from about 100 to about 700, alternatively from about 150 to about 700, alternatively from about 200 to about 700, alternatively from about 400 to about 700, alternatively about 150, alternatively about 160, alternatively about 230, alternatively, about 250, alternatively about 460, alternatively about 660, mg KOH/g when tested according to ASTM D4739.

The lubricant composition also has a TBN. The various components of the lubricant composition, e.g. the amine, the detergent, the dispersant, etc., contribute to the TBN of the lubricant composition. In various embodiments, the lubricant composition has a TBN of from about 10 to about 150, alternatively from about 20 to about 90, alternatively from about 30 to about 90, alternatively from about 30 to about 80, alternatively from about 30 to about 70, alternatively from about 20 to about 50, alternatively from about 20 to about 40, alternatively from about 20 to about 35, alternatively from about 50 to about 70, mg KOH/g when tested according to ASTM D4739. In some embodiments, the amine contributes less than about 29, alternatively less than about 28, alternatively less than about 27, alternatively less than about 26, alternatively, alternatively less than about 25, alternatively less than about 20, alternatively less than about 15, alternatively less than about 10, alternatively less than about 7, alternatively less than about 5, alternatively less than about 3, from about 0.1 to about 28, alternatively from about 0.1 to about 29, alternatively from about 0.1 to about 25, alternatively from about 0.1 to about 20, alternatively from about 0.1 to about 10, alternatively from about 0.1 to about 7, alternatively from about 0.1 to about 5, alternatively from about 0.1 to about 3, % of the lubricant composition. The TBN of the lubricant composition and the TBN contribution of the amine may vary outside of the ranges above, but are typically both whole and fractional values within these ranges. For example, when the amine contributes less than about 28% to the TBN of a lubricant composition having a TBN of 50 mg KOH/g, the amine contributes less than about 14 mg KOH/g to the TBN of the lubricant composition. The amine does not contribute substantially to the total TBN of the lubricant composition, but a small amount of the amine with a reduced amount of detergent, provide significant acid neutralization. The acid neutralization attained with a use of a small amount of the amine and a reduced amount of detergent may be at least comparable (and in some instances better) to the acid neutralization attained when using a larger amount of the detergent by itself. These results illustrate that lower amounts of amine and detergent may be used to minimize ash formation and damage to the engine, improve fuel economy, and elongate engine life. The TBN of the lubricant composition may vary outside of the ranges listed above, but is typically both whole and fractional values within these ranges.

The amine may be selected from the group consisting of (I), (II), (III), (IV), and (V) as defined below:

(I)

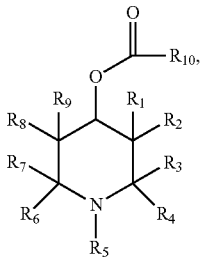

wherein each of $R_1$ to $R_9$ are independently selected from a hydrogen, a $C_{1-6}$ branched or straight alkyl or a halogen; and $R_{10}$ is selected from hydrogen, hydroxy or a $C_{1-20}$ branched or straight alkyl;

in certain embodiments, $R_1$, $R_2$, $R_5$, $R_8$, and $R_9$ are hydrogen and $R_3$, $R_4$, $R_7$ and $R_8$ are independently a $C_{1-3}$ alkyl;

in certain embodiments, $R_{10}$ is a $C_{8-15}$ alkyl;

in one embodiment, $R_1$, $R_2$, $R_5$, $R_8$, and $R_9$ are hydrogen; $R_3$, $R_4$, $R_7$ and $R_8$ are a methyl; and $R_{10}$ is a $C_{11}$ alkyl;

(II)

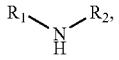

wherein $R_1$ and $R_2$ are independently selected from $C_{1-20}$ branched or straight alkyl;

in certain embodiments, $R_1$ and $R_2$ are independently selected from a $C_{6-12}$ alkyl;

in one embodiment, $R_1$ and $R_2$ are both a branched $C_8$ alkyl;

(III)

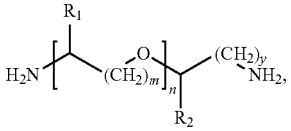

wherein each of $R_1$ and $R_2$ are independently selected from a hydrogen, a $C_{1-6}$ branched or straight alkyl or a halogen; m and y are independently an integer of 1 to 6 and n is 1 to 7;

in certain embodiments, $R_1$ and $R_2$ are independently selected from a $C_{1-3}$ alkyl;

in certain embodiments, m and y are independently an integer of 1-3;

in certain embodiments, n is an integer or a fractional number of 2 to 6.5;

in one embodiment, $R_1$ and $R_2$ are both a methyl and m and y are both 1;

in one embodiment, n is 2.5; in one embodiment n is 6.1;

in certain embodiments, the average molecular weight (average $M_n$) of amine (III) ranges from about 100 to about 500, from about 200 to about 450, or from about 230 to about 430, about 230, or about 430.

(IV)

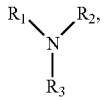

wherein $R_1$, $R_2$, and $R_3$ are independently selected from $C_{1-20}$ branched or straight alkyl;

in certain embodiments, $R_1$, $R_2$ and $R_3$ are independently selected from a $C_{6-12}$ alkyl;

in one embodiment, $R_1$, $R_2$ and $R_3$ are both a branched $C_8$ alkyl; and (V)

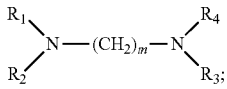

wherein $R_1$ to $R_4$ are independently selected from hydrogen and a $C_{1-6}$ alkyl and m is an integer of 1-12;

in certain embodiments, $R_1$ to $R_4$ are a $C_{1-3}$ alkyl and m is an integer of 4-8;

in one embodiment, $R_1$ to $R_4$ are a methyl and m is 6.

In some embodiments, the amine may be selected from the group consisting of:

(Ia)

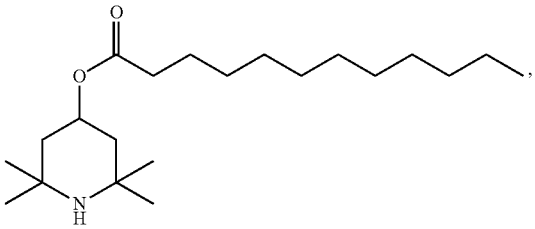

(IIa)

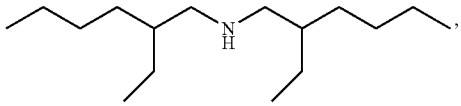

(IIIa)

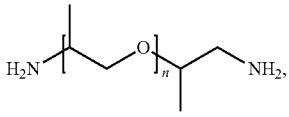

(IVa)

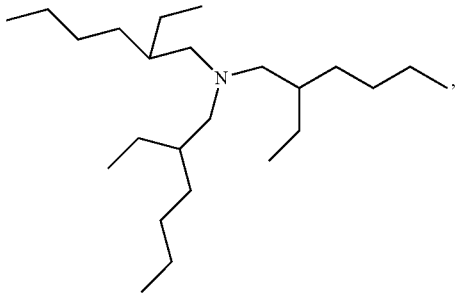

and

-continued (Va)

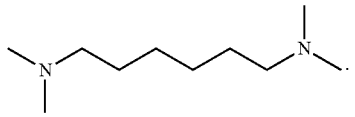

In this embodiment, amine (Ia) has a TBN of about 158 mg KOH/g when tested according to ASTM D2896, amine (IIa) has a TBN of about 232 mg KOH/g when tested according to ASTM D2896, amine (IIIa) with an average molecular weight (average $M_n$) of 230 and n of 2.5 has a TBN of about 461 mg KOH/g when tested according to ASTM D2896, amine (IIIa) with an average molecular weight (average $M_n$) of 430 and n of 6.1 has a TBN of about 253 mg KOH/g when tested according to ASTM D2896, amine (IVa) has a TBN of about 163 mg KOH/g when tested according to ASTM D2896, and amine (Va) has a TBN of about 668 mg KOH/g when tested according to ASTM D2896. As such, the amines of structures (I)-(V) can be added to the lubricant composition in smaller quantities than amines having a lower TBN and to achieve the desired TBN value of the lubricant composition. That is, because of their structure and basicity, amine structures (I)-(V) are very efficient and have excellent solubility in the lubricant composition.

In various embodiments, the amine may be present in the lubricant composition in an amount of from about 0.01 to about 32, alternatively from about 0.1 to about 25, alternatively from about 0.1 to about 20, alternatively from about 0.1 to about 10, alternatively from about 0.1 to about 5, wt. % based on the total weight of the lubricant composition. The amount of amine may vary outside of the ranges above, but is typically both whole and fractional values within these ranges. Further, it is to be appreciated that more than one amine may be included in the lubricant composition, in which case the total amount of all the amine included is within the above ranges.

The lubricant composition also includes a detergent. The detergent is typically selected from overbased or neutral metal sulfonates, phenates and salicylates, and combinations thereof. In some embodiments, the detergent comprises metallic salts of alkyl phenol sulfides, which are sometimes referred to in the art as "phenates". In some embodiments, the detergent comprises metallic salts of alkaryl sulfonic acids commonly referred to as "sulfonates". The detergent is designed to be soluble in oil, and insoluble in water.

In various embodiments, the detergent comprises an overbased metal sulfonate, salicylate, or phenate, detergent. In one embodiment, the detergent comprises an overbased metal sulfonate, such as calcium sulfonate. In many preferred embodiments, the detergent comprises a calcium sulfonate, salicylate, or phenate. In one embodiment, the detergent comprises an overbased metal salicylate, such as calcium metal salicylate. In yet another embodiment, the detergent comprises an alkyl phenate detergent.

In some embodiments, the detergent is an overbased calcium sulfonate. In some embodiments, the calcium sulfonate has a calcium content of from about 6 to about 14, alternatively from about 8 to about 12, alternatively from about 6 to about 11, wt. % based on the total weight of said calcium sulfonate detergent and/or a TBN of from about 250 to about 550, alternatively from about 250 to about 450, alternatively from about 250 to about 350, mg KOH/g when tested according to ASTM D2896. In some embodiments, the amine and the overbased calcium sulfonate detergent are present in a weight/weight ratio of from about 1:1 to about 1:30, alternatively from about 1:2 to about 1:15, alternatively from about 1:2.5 to about 1:10. The ratio may vary outside of the ranges above, but is typically both whole and fractional values within these ranges.

The detergent typically includes metals such as sodium, potassium, calcium, and the like which can react to form ash. It is believed that inclusion of the amine in the additive composition reduces the amount of detergent required in the lubricant composition and reduces the total TBN of the lubricant composition required to be effective. Since the amine is ashless, and the amount of excess detergent, e.g. overbased detergent, which forms ash and plates out onto cylinder walls and other engine components, is reduced, the damaging effects of the overbased detergent are also reduced.

If included, the detergent may be included in the lubricant composition in an amount of from about 0.1 to about 35, alternatively from about 0.1 to about 10, alternatively from about 0.1 to about 7.5, alternatively from about 0.1 to about 5, alternatively from about 1 to about 5, alternatively from about 1 to about 4, alternatively from about 1 to about 3, alternatively from about 1 to about 2.5, wt. % based on the total weight of the lubricant composition. Alternatively, less than about 7.5, less than about 5, less than about 4, less than about 3, less than about 2, or less than about 1, wt. %, each based on the total weight of the lubricant composition. The amount of detergent may vary outside of the ranges above, but is typically both whole and fractional values within these ranges. Further, it is to be appreciated that more than one detergent may be included in the lubricant composition, in which case the total amount of all the detergent included may be within the above ranges.

The lubricant composition may also include a dispersant. In various embodiments, the lubricant composition does not include a dispersant. In embodiments where the lubricant composition does not include, or is substantially free of (e.g., includes less than about 5, alternatively less than about 2, alternatively less than about 1, alternatively less than about 0.1, alternatively about 0, wt. % based on the total weight of the lubricant composition) the dispersant, it is believed that the amine's compatibility and solubility in the lubricant composition allows for inclusion of a reduced amount of or no dispersant in the lubricant composition.

In some embodiments, the dispersant comprises a polyalkenyl succinic anhydride polyamine and/or a polyalkenyl succinimide polyamine. While not intending to be bound by theory, it is contemplated that the dispersant (e.g. the polyalkenyl succinic anhydride polyamine and/or the polyalkenyl succinimide polyamine), when present, contributes to the solubility of the amine in the base oil. Additional dispersants such as polybutenylphosphonic acid derivatives and basic magnesium, calcium and barium sulfonates and phenolates, succinate esters and alkylphenol amines (Mannich bases), polyalkene amines, and combinations thereof can also be included in the lubricant composition.

In one embodiment, the dispersant comprises a polyalkenyl succinic anhydride polyamine, such as polybutenyl succinic anhydride polyamine ("PIBSA-PAM"). In this embodiment, the PIBSA-PAM has weight average molecular weight ($M_w$) of from about 200 to about 3000, alternatively from about 200 to about 1500, alternatively from about 400 to about 1200, alternatively from about 600 to about 1200, alternatively from about 850 to about 950, alternatively about 900, g/mol.

In another embodiment, the dispersant comprises a polyalkenyl succinimide polyamine, such as polyisobutylenesuccinimide ("PIBSI"). In this embodiment, the PIBSI has a weight average molecular weight ($M_w$) of from about 200 to about 3000, alternatively from about 200 to about 1500, alternatively from about 600 to about 1200, alternatively from about 850 to about 950, alternatively about 900, g/mol.

In some embodiments, the lubricant composition is free of or substantially free of the dispersant. In some embodiments, the lubricant composition is free of or substantially free of PIBSA-PAM. In some embodiments, the lubricant composition is free of or substantially free of PIBSI. The terminology "substantially free," as used immediately above and throughout this disclosure, refers to an amount of dispersant (or other additive) less than about 5, alternatively less than about 4, alternatively less than about 3, alternatively less than about 2, alternatively less than about 1, alternatively less than about 0.01, alternatively about 0, wt. % based on the total weight of the lubricant composition.

If included, the dispersant may be included in the lubricant composition in an amount of from about 0.1 to about 15, alternatively from about 0.1 to about 10, alternatively from about 0.1 to about 8, alternatively from about 0.1 to about 6, alternatively from about 0.1 to about 4, alternatively from about 0.1 to about 3, alternatively from about 1 to about 3, wt. % based on the total weight of the lubricant composition. Alternatively, the dispersant may be included in the lubricant composition in amounts of less than about 15, less than about 12, less than about 10, less than about 5, or less than about 4, wt. %, each based on the total weight of the lubricant composition. The amount of dispersant may vary outside of the ranges above, but is typically both whole and fractional values within these ranges. Further, it is to be appreciated that more than one dispersant may be included in the lubricant composition, in which case the total amount of all the dispersant included may be within the above ranges.

The lubricant composition may also include a base oil. The base oil is classified according to the American Petroleum Institute (API) Base Oil Interchangeability Guidelines. That is, the base oil may be further described as one or more of five types of base oils: Group I (sulfur content >0.03 wt. %, <90 wt. % saturates, viscosity index 80-120); Group II (sulfur content less than or equal to 0.03 wt. %, and greater than or equal to 90 wt. %, saturates viscosity index 80-120); Group III (sulfur content less than or equal to 0.03 wt. %, and greater than or equal to 90 wt. % saturates, viscosity index greater than or equal to 120); Group IV (all polyalphaolefins (PAO's); and Group V (all others not included in Groups I, II, III, or IV).

In one embodiment, the base oil is selected from American Petroleum Institute (API) Group I oil, API Group II oil, API Group III oil, API Group IV oil, API Group V oil, and combinations thereof. In another embodiment, the base oil comprises an API Group I oil. In yet another embodiment, the base oil comprises an API Group II oil.

In still other embodiments, the base oil may be further defined as synthetic oil that includes one or more alkylene oxide polymers and interpolymers, and derivatives thereof. The terminal hydroxyl groups of the alkylene oxide polymers may be modified by esterification, etherification, or similar reactions. These synthetic oils may be prepared through polymerization of ethylene oxide or propylene oxide to form polyoxyalkylene polymers which can be further reacted to form the synthetic oil. For example, alkyl and aryl ethers of these polyoxyalkylene polymers may be used. For example, methylpolyisopropylene glycol ether having an average molecular weight of 1000; diphenyl ether of polyethylene glycol having a molecular weight of 500-1000; or diethyl ether of polypropylene glycol having a molecular weight of 1000-1500 and/or mono- and polycarboxylic esters thereof, such as acetic acid esters, mixed $C_3$-$C_8$ fatty acid esters, and the $C_{13}$ oxo acid diester of tetraethylene glycol may also be utilized as the base oil.

The base oil may be included in the lubricant composition in an amount of from about 40 to about 99.9, alternatively from about 50 to about 99.9, alternatively from about 50 to about 95, alternatively from about 50 to about 80, wt. % based on the total weight of the lubricant composition. Alternatively, the base oil may be included in the lubricant composition in amounts of greater than about 50, alternatively greater than about 60, alternatively greater than about 70, alternatively greater than about 75, alternatively greater than about 80, alternatively greater than about 85, alternatively greater than about 90, alternatively greater than about 95, wt. % based on the total weight of the lubricant composition. The amount of base oil may vary outside of the ranges above, but is typically both whole and fractional values within these ranges. Further, it is to be appreciated that more than one base oil may be included in the lubricant composition, in which case the total amount of all the base oil included may be within the above ranges.

The lubricant composition may also include an antiwear additive. Any antiwear additive known in the art may be included. Suitable, non-limiting examples of the antiwear additive include zinc dialkyl-dithio phosphate ("ZDDP"), zinc dialkyl-dithio phosphates, sulfur- and/or phosphorus- and/or halogen-containing compounds, e.g. sulfurised olefins and vegetable oils, zinc dialkyldithiophosphates, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, bis(2-ethylhexyl)aminomethyltolyltriazole, derivatives of 2,5-dimercapto-1,3,4-thiadiazole, ethyl 3-[(diisopropoxyphosphinothioyl)thio]propionate, triphenyl thiophosphate (triphenylphosphorothioate), tris(alkylphenyl) phosphorothioate and mixtures thereof (for example tris(isononylphenyl) phosphorothioate), diphenyl monononylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris[isooctyl 2-acetate], derivatives of 2-mercaptobenzothiazole such as 1-[N,N-bis(2-ethylhexyl)aminomethyl]-2-mercapto-1H-1,3-benzothiazole, ethoxycarbonyl-5-octyldithio carbamate, ashless antiwear additives including phosphorous, and/or combinations thereof. In one embodiment, the antiwear additive comprises ZDDP.

If included, the antiwear additive may be included in the lubricant composition in an amount of from about 0.1 to about 10, alternatively from about 0.1 to about 5, alternatively from about 0.1 to about 4, alternatively from about 0.1 to about 3, alternatively from about 0.1 to about 2, alternatively from about 0.1 to about 1, alternatively from about 0.1 to about 0.5, wt. % based on the total weight of the lubricant composition. Alternatively, the antiwear additive may be included in the lubricant composition in amounts of less than about 10, less than about 9, less than about 8, less than about 7, less than about 6, less than about 5, less than about 4, less than about 3, less than about 2, or less than about 1, wt. %, each based on the total weight of the lubricant composition. The amount of antiwear additive may vary outside of the ranges above, but is typically both whole and fractional values within these ranges. Further, it is to be appreciated that more than one antiwear additive may be included in the lubricant composition, in which case the total amount of all the antiwear additives included may be within the above ranges.

The lubricant composition may also include a pour point depressant. Any pour point depressant known in the art may be included. The pour point depressant is typically selected from polymethacrylate and alkylated naphthalene derivatives, and combinations thereof.

If included, the pour point depressant may be included in the lubricant composition in an amount of from about 0.01 to about 5, alternatively from about 0.01 to about 2, alternatively from about 0.01 to about 1, alternatively from about 0.1 to about 0.5, wt. % based on the total weight of the lubricant composition. Alternatively, the pour point depressant may be included in the lubricant composition in amounts of less than about 5, less than about 4, less than about 3, less than about 2, less than about 1, wt. %, each based on the total weight of the lubricant composition. The amount of pour point depressant may vary outside of the ranges above, but is typically both whole and fractional values within these ranges. Further, it is to be appreciated that more than one pour point depressant may be included in the lubricant composition, in which case the total amount of all the pour point depressants included may be within the above ranges.

The lubricant composition may also include an antifoam agent. Any antifoam agent known in the art may be included. The antifoam agent is typically selected from silicone antifoam agents, acrylate copolymer antifoam agents, and combinations thereof.

If included, the antifoam agent may be included in the lubricant composition in an amount of from about 1 to about 1000, alternatively from about 1 to about 500, alternatively from about 1 to about 400, ppm based on the total weight of the lubricant composition. Alternatively, the antifoam agent may be included in the lubricant composition in amounts of less than about 1000, less than about 500, less than about 400, ppm, each based on the total weight of the lubricant composition. The amount of antifoam agent may vary outside of the ranges above, but is typically both whole and fractional values within these ranges. Further, it is to be appreciated that more than one antifoam agent may be included in the lubricant composition, in which case the total amount of all the antifoam agent included may be within the above ranges.

In addition to the components described above, e.g., the ashless fuel additive, the base oil, the detergent, etc., the lubricant composition may additionally include one or more additives to improve various chemical and/or physical properties. Non-limiting examples of the one or more additives include antioxidants, metal passivators, and viscosity index improvers. Each of the additives may be used alone or in combination. If included, the one or more additives can be included in various amounts.

In various embodiments, the lubricant composition comprises, consists essentially of, or consists of the amine, an API Group I oil(s), and a detergent comprising as over-based calcium sulfonate.

In some embodiments, the lubricant is substantially free of the detergent. The terminology "substantially free," as used immediately above and throughout this disclosure, refers to an amount of detergent (or other additive) less than about 5, alternatively less than about 4, alternatively less than about 3, alternatively less than about 2, alternatively less than about 1, alternatively less than about 0.01, alternatively about 0, wt. % based on the total weight of the lubricant composition.

In various embodiments, the lubricant composition can be further described as a fully formulated lubricant or alternatively as an engine oil. In one embodiment, the terminology "fully formulated lubricant" refers to a total final composition that is a final commercial oil. This final commercial oil may include, for instance, antiwear additives, dispersants, detergents, and other customary additives.

In yet other embodiments, the lubricant composition comprises, consists of, or consists essentially of:

(i) an amine selected from the group consisting of:

(Ia)

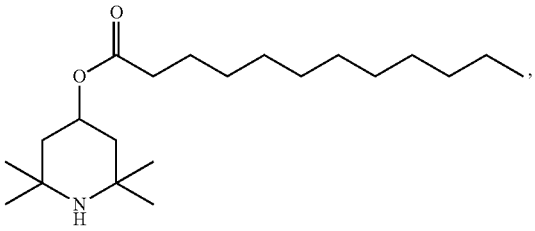

(IIa)

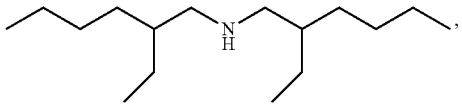

(IIIa)

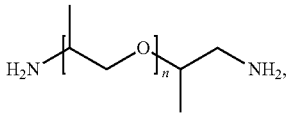

(IVa)

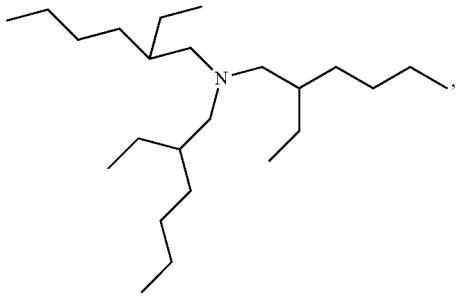

and (Va)

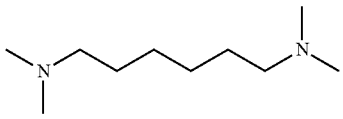

; and (ii) overbased calcium sulfonate detergent, wherein the amine and the overbased calcium sulfonate detergent are present in a weight/weight ratio of from 1:1 to about 1:30, alternatively from about 1:2 to about 1:15, alternatively from about 1:2.5 to about 1:10. The ratio may vary outside of the ranges above, but is typically both whole and fractional values within these ranges.

As alluded to above, the amine, when used in minimal amounts, e.g. contributing from about 0.1 to about 28% of the TBN of the lubricant composition, and in combination with an overbased calcium sulfonate detergent, has an unexpected effect on acid neutralization (as shown in the examples). In many embodiments, the use of the amine decreases an amount (by weight) of overbased calcium sulfonate detergent required to neutralize acid by greater than about 25%, or even greater than about 50%. That is, the combined performance of the amine and overbased calcium sulfonate detergent allows for use of a minimal amount of amine in the lubricant composition and a significant reduction in the amount of the detergent in the lubricant composition.

Further, the amine provides excellent solubility in the lubricant composition. It is also believed that the various structural embodiments of the amine set forth above in combination with a detergent comprising a metal sulfonate and a polybutenyl succinic anhydride polyamine yields a homogenous lubricant composition which does not phase separate and/or yield a precipitate (has excellent solubility characteristics) even when stored for various times (e.g. 90 days) at various temperatures (e.g. −4° C., 4° C., 45° C., or 60° C.). For example, in various embodiments, the lubricant composition remains homogeneous and does not phase separate when exposed to: a temperature of 60° C. for 90 days; a temperature of 45° C. for 90 days; a temperature of 4° C. for 90 days; and/or a temperature of −4° C. for 90 days.

All the while, the lubricant composition is ashless (or low ash). The word "ashless" as used herein to describe the lubricant composition refers to the lubricant composition including the amine, which is ashless, and therefore a lubricant composition including less detergent, which can contribute to ash formation.

That is, the lubricant composition may also be further defined as ashless or ash-containing, according to ASTM D 874 or as is known in the art. Typically, the terminology "ashless" refers to the absence of significant amounts of metals such as sodium, potassium, calcium, and the like. Of course, it is to be understood that the lubricant composition is not particularly limited to being defined as ashless because use of the word ashless is intended to reflect use of the amine, which is ashless, and subsequent reduction of detergent, which can contribute to ash, in the composition and thus the lubricant composition could be interpreted as ash-containing, e.g. interpreted as a "reduced ash composition".

In one or more embodiments, the lubricant composition may be classified as a low SAPS lubricant having a sulfated ash content of no more than 8, 7, 6, 5, 4, 3, 2, 1, or 0.5, wt. %, based on the total weight of the lubricant composition when tested according to ASTM D874. The term "SAPS" refers to sulfated ash, phosphorous and sulfur. Alternatively, in one or more embodiments, the lubricant composition may be classified as having a sulfated ash value of less than about 45,000, alternatively less than about 40,000, alternatively less than about 35,000, alternatively less than about 30,000, alternatively less than about 25,000, ppm when tested according to ASTM D874.

The subject disclosure also provides a method of lubricating an internal combustion engine. The method of lubricating an internal combustion engine comprises the steps of injecting a fuel and the lubricant composition into a cylinder to form a mixture, and combusting the mixture via compression-ignition. In various embodiments, the fuel and the lubricant composition are injected into the cylinder at a ratio of from about 100:1 to about 1000:1, alternatively from about 200:1 to about 400:1. The lubricant composition and the components thereof, e.g. the amine, the detergent, etc., are set forth and described above. In one embodiment, the fuel comprises sulfur, e.g. diesel fuel comprising sulfur.

In a typical embodiment, the lubricant composition is used in a diesel engine (also known in the art as a compression-ignition engine). Diesel engines are typically internal combustion engines that use the heat of compression to initiate ignition and burn the fuel and the lubricant composition is injected into the cylinder/combustion chamber. Compression-ignition engines lie in contrast to spark-ignition engines such as a gasoline (petrol) engine or gas engine (using a gaseous fuel as opposed to gasoline), which use a spark plug to ignite an air-fuel mixture. In one specific embodiment, the combustion engine is further defined as a compression-ignition internal combustion engine for a marine vessel, i.e., a marine combustion engine. In another specific embodiment, the combustion engine is further defined as a compression-ignition internal combustion engine for a train, i.e., a train or railroad combustion engine. Of course, the ashless fuel additive is not limited to use in combustion engines for marine applications. Use of the ashless fuel additive in other combustion engines, for other applications, such as automobiles, trucks, aircraft, trains, motorcycles, scooters, ATVs, lawn equipment, etc., is also contemplated herein.

In this method, a mixture comprising the combined fuel and lubricant composition may be injected/introduced into a cylinder of the internal combustion engine and combusted to move a piston and power the internal combustion engine. In one embodiment, the fuel and the lubricant are combined in advance of injection into the cylinder. In another embodiment, the fuel and the lubricant are injected separately into the cylinder. In yet another embodiment, the fuel and lubricant are combined in the cylinder.

The following examples are intended to illustrate the instant disclosure and are not to be viewed in any way as limiting to the scope of the instant disclosure.

EXAMPLES

Examples 1-6 are lubricant compositions according to the subject disclosure. Examples 1-6 include an amine, a detergent, and an API Group I oil, and are described in Table 1 below. Comparative Examples 1 and 2 are set forth for comparative purposes in Table 2 below. Examples 1-6 show that use of a small amount of the amine can drastically reduce the amount of detergent required to neutralize acid even though the total lubricant composition TBN of the examples of Table 1 is lower than the total lubricant composition TBN of the examples of Table 2.

Examples 1-6 and comparative examples 1 and 2 are tested for corrosion in accordance with ASTM D665—Standard Test Method for Rust-Preventing Characteristics of Inhibited Mineral Oil in the Presence of Water. The protocol set forth in ASTM D665 is followed, with the exception that the water in replaced with 2N $H_2SO_4$ and the test duration was 10 minutes. To start, a steel rod is submerged in 300 g of each particular example composition in a reaction vessel at 60° C. The steel rod is submerged in the example composition and aged, with stirring, for 30 min. After aging, 2N $H_2SO_4$ is added to the reaction vessel to form a reaction mixture and the steel bar is aged in the reaction mixture at a temperature of 60° C. for 10 minutes. After aging, the steel bar is examined for corrosion. The results of the corrosion testing are set forth in Table 1 and in Table 2 below, a scale of from 1-10 is used to quantify the amount of corrosion, with 10 being significant corrosion covering greater than 90% of the surface area of the steel bar and 1 being no corrosion.

TABLE 1

| | Example 1 | Example 2 | Example 3 |
|---|---|---|---|
| Amine Structure | 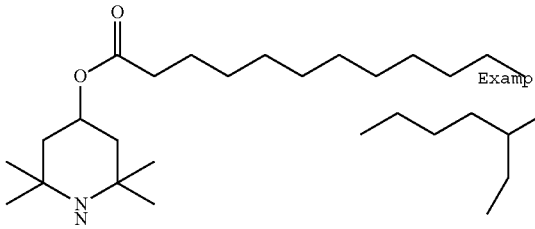 | 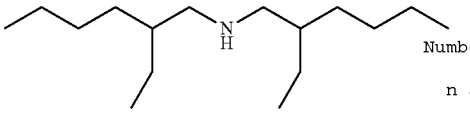 | 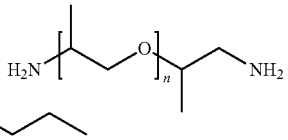 Numbert Average MW 230 n about 2.5 |
| Amine TBN (mg KOH/g) ASTM D 2896 | 158 | 232 | 461 |
| Amine TBN Contribution (mg KOH/g) ASTM D 2896 | 1.6 | 2.3 | 2.3 |
| Detergent TBN Contribution (mg KOH/g) ASTM D 2896 | 25 | 25 | 25 |
| Total Lubricant Comp. TBN (mg KOH/g) ASTM D 2896 | 26.6 | 27.3 | 27.3 |
| % TBN Contribution of the Amine | 6.0% | 8.4% | 8.4% |
| Corrosion Results | 2 | 6 | 2 |

| | Example 4 | Example 5 | Example 6 |
|---|---|---|---|
| Amine Structure | 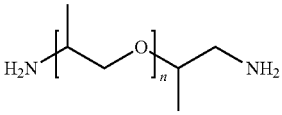 Number Average MW 430 n about 6.1 | 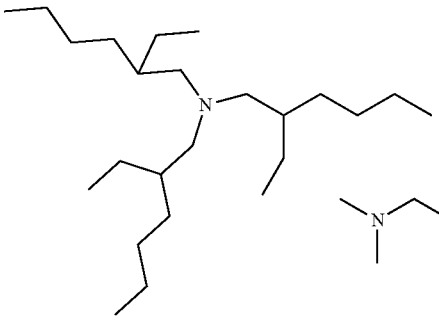 | 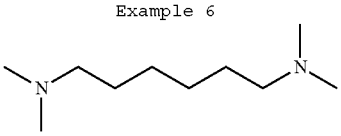 |
| Amine TBN (mg KOH/g) ASTM D 2896 | 253 | 163 | 668 |
| Amine TBN Contribution (mg KOH/g) ASTM D 2896 | 1.3 | 0.16 | 6.7 |
| Detergent TBN Contribution (mg KOH/g) ASTM D 2896 | 25 | 25 | 25 |
| Total Lubricant Comp. TBN (mg KOH/g) ASTM D 2896 | 26.3 | 25.16 | 31.7 |
| % TBN Contribution of the Amine | 4.9% | 0.6% | 21.1% |
| Corrosion Results | 2 | 3 | 3 |

TABLE 2

| | Comparative Example 1 | Comparative Example 2 |
|---|---|---|
| Amine TBN Contribution (mg KOH/g) ASTM D 2896 | — | — |
| Detergent TBN Contribution (mg KOH/g) ASTM D 2896 | 50 | 90 |
| Total Lubricant Comp. TBN (mg KOH/g) ASTM D 2896 | 50 | 90 |
| % TBN Contribution of the Amine | 0% | 0% |
| Corrosion Results | 7 | 7 |

The various amines that were tested are listed in Table 1.

The detergent was an overbased calcium sulfonate detergent having a TBN of about 300 mg KOH/g when tested according to ASTM D2896.

Referring now to Table 1, Examples 1-6, which include the amine, neutralize the $H_2SO_4$ and significantly reduce the amount of corrosion. Notably, Examples 1-6 have a lower TBN and include 50% less overbased calcium sulfonate detergent than Comparative Examples 1 and 2. As such, a minimal amount of the amine allows for a significant reduction in the total base number of the composition, and a significant reduction in the amount of the overbased calcium sulfonate detergent. In other words, utilization of the amine in combination with the overbased calcium sulfonate detergent provides an enhanced effect on neutralization (as compared to the detergent by itself), and decreases the amount of ash formed since a lower amount of detergent is required.

It is to be understood that the appended claims are not limited to express any particular compounds, compositions, or methods described in the detailed description, which may vary between particular embodiments that fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and/or in combination and provides adequate support for specific embodiments within the scope of the appended claims.

It is also to be understood that any ranges and subranges relied upon in describing various embodiments of the present invention independently and collectively fall within the scope of the appended claims and are understood to describe and contemplate all ranges, including whole and/or fractional values therein, even if such values are not expressly written herein. One of skill in the art readily recognizes that the enumerated ranges and subranges sufficiently describe and enable various embodiments of the present invention and such ranges and subranges may be further delineated into relevant halves, thirds, quarters, fifths, and so on. As just one example, a range "from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims and may be relied upon individually and/or collectively and provide adequate support for specific embodiments within the scope of the appended claims.

In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange ranging from at least 10 to 35, a subrange ranging from at least 10 to 25, a subrange from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "from 1 to 9" includes various individual integers, such as 3, as well as individual numbers including a decimal point (or fraction), such as 4.1, which may be relied upon and provide adequate support for specific embodiments within the scope of the appended claims.

The invention has been described in an illustrative manner and it is to be understood that the terminology which has been used is intended to be in the nature of words of description rather than of limitation. Many modifications and variations of the present invention are possible in light of the above teachings and the invention may be practiced otherwise than as specifically described.

What is claimed is:

1. A lubricant composition for a compression-ignition internal combustion engine, said lubricant composition comprising:

(A) an amine selected from the group consisting of (I), (III), and (IV) defined as follows:

(I)

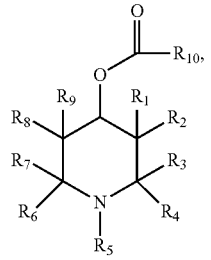

wherein each of $R_1$ to $R_9$ are independently selected from a hydrogen, a $C_{1-6}$ branched or straight alkyl or a halogen; and $R_{10}$ is selected from hydrogen, hydroxy or a $C_{1-20}$ branched or straight alkyl;

(II)

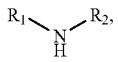

wherein $R_1$ and $R_2$ are independently selected from $C_{1-20}$ branched or straight alkyl;

(III)

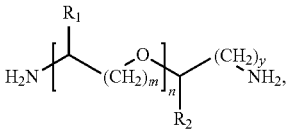

wherein each of $R_1$ and $R_2$ are independently selected from a hydrogen, a $C_{1-6}$ branched or straight alkyl or a halogen; m and y are independently an integer of 1 to 6 and n is 1 to 7;

(IV)

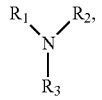

wherein $R_1$, $R_2$, and $R_3$ are independently selected from $C_{1-20}$ branched or straight alkyl; and (V)

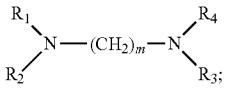

wherein $R_1$ to $R_4$ are independently selected from hydrogen and a $C_{1-6}$ alkyl and m is an integer of 1-12; and (B) a detergent selected from metal sulfonates, phenates, salicylates, carboxylates, thiophosphonates, and combinations thereof, wherein a TBN of said lubricant composition is from about 10 to about 100 mg KOH/g when tested according to ASTM D2896; and wherein a TBN contribution of said amine to said TBN of said lubricant composition is from about 0.1 to about 28%.

2. The lubricant composition as set forth in claim 1, comprising the amine of group (I), wherein $R_1$, $R_2$, $R_5$, $R_8$, and $R_9$ are hydrogen and $R_3$, $R_4$, $R_7$ and $R_8$ are independently a $C_{1-3}$ alkyl; and wherein $R_{10}$ is a $C_{8-15}$ alkyl.

3. The lubricant composition as set forth in claim 2, wherein $R_1$, $R_2$, $R_5$, $R_8$, and $R_9$ are hydrogen; $R_3$, $R_4$, $R_7$ and $R_8$ are a methyl; and $R_{10}$ is a $C_{11}$ alkyl.

4. The lubricant composition as set forth in claim 3, wherein the amine has a structure of formula (Ia):

(Ia)

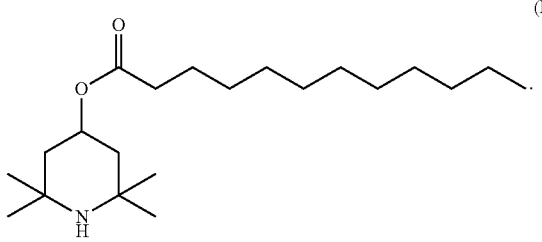

5. The lubricant composition as set forth in claim 1 wherein a TBN contribution of said amine to said TBN of said lubricant composition is from about 0.1 to about 20%.

6. The lubricant composition as set forth in claim 1 wherein said detergent comprises calcium.

7. The lubricant composition as set forth in claim 1 wherein said detergent comprises a calcium sulfonate.

* * * * *